US005581334A

United States Patent [19]

Forlani et al.

[11] Patent Number: 5,581,334

[45] Date of Patent: Dec. 3, 1996

[54] ELECTROSTATIC IMAGE DEVELOPING DEVICE HAVING TONER FLOW CONTROL AND LUMPS FORMATION PREVENTION ABILITY

[75] Inventors: Riccardo Forlani, Turin; Renato Bortolin, Castellamonte; Riccardo Dal Bianco, Turin; Roberto Guelfo, Montanaro, all of Italy

[73] Assignee: Olivetti-Canon Industriale S.p.A., Ivrea, Italy

[21] Appl. No.: 375,484

[22] Filed: Jan. 19, 1995

[30] Foreign Application Priority Data

Feb. 7, 1994 [IT] Italy ..... TO94A0066

[51] Int. Cl.[6] ..... G03G 15/06

[52] U.S. Cl. ..... 355/245; 118/653

[58] Field of Search ..... 355/260, 245, 355/246, 251, 259, 253; 118/653, 656–658; 222/DIG. 1

[56] References Cited

U.S. PATENT DOCUMENTS

| | | | |
|---|---|---|---|
| 4,456,364 | 6/1984 | Hatzis | 355/260 |
| 4,468,111 | 8/1984 | Yamagata et al. . | |
| 4,743,936 | 5/1988 | Bares | 355/260 |
| 5,124,752 | 6/1992 | Kanno et al. | 355/253 |
| 5,134,441 | 7/1992 | Nagata et al. | 355/245 |
| 5,142,333 | 8/1992 | Verbeek et al. | 355/245 |
| 5,202,732 | 4/1993 | Yahata | 355/260 |
| 5,383,009 | 1/1995 | Tsusaka | 355/260 |
| 5,430,530 | 7/1995 | Ott et al. | 355/260 |

FOREIGN PATENT DOCUMENTS

| | | |
|---|---|---|
| 366052 | 5/1990 | European Pat. Off. . |
| 571177 | 11/1993 | European Pat. Off. . |

OTHER PUBLICATIONS

Patent Abstracts Of Japan, vol. 010, No. 364 (P–524), Dec. 5, 1986.

Patent Abstracts Of Japan, vol. 010, No. 198 (P–476), Jul. 11, 1986.

Patent Abstracts Of Japan, vol. 010, No. 334 (P–515), Nov. 13, 1986.

*Primary Examiner*—Arthur T. Grimley
*Assistant Examiner*—T. A. Dang
*Attorney, Agent, or Firm*—Banner & Witcoff, Ltd.

[57] ABSTRACT

In an electrostatic image developing device for electrical photocopiers, a magnetizable one-component toner, initially contained in a removable container, is fed, by the action of a rotating flexible strip, through a development chamber towards a rotating non-magnetic development roller surrounding a number of stationary permanent magnets, forming on it a magnetic brush, whose thickness is controlled by a non-magnetic flexible blade pressed against the surface of the development roller; the development chamber is fitted with three stirring bars made of non-magnetic material, each bar describing a different closed path in different zones of the development chamber in such a way as to avoid the formation of lumps and to maintain the correct fluidity of the toner. In addition, a metallic wire is fitted in the development chamber and acts as a sensor device to detect when the removable container is nearly empty of toner.

14 Claims, 4 Drawing Sheets

ELECTROSTATIC IMAGE DEVELOPING DEVICE HAVING TONER FLOW CONTROL AND LUMPS FORMATION PREVENTION ABILITY

BACKGROUND OF THE INVENTION

The present invention concerns a development unit for electric photocopiers and, more specifically, a development unit using a magnetizable one-component toner initially contained in a removable container of cylindrical shape, from which it is fed across a development chamber towards a rotating development sleeve made of a non-magnetic material inside which are contained a number of stationary permanent magnets.

As is known, on the outer surface of the development sleeve the magnetic field generated by the magnets forms a layer of toner known as the magnetic brush, in which the thickness of the layer is limited by the action of a metering blade made of a non-magnetic material which is fixed, and rests elastically in contact with the surface of the development sleeve.

Various types of development units with magnetic brushes of the above type are known, in which the excess toner on the magnetic brush, which is removed by the metering blade, tends to accumulate upstream from the blade itself with respect to the rotation direction of the development drum, so giving rise to a compacting effect of the toner which forms more or less solid lumps. When this happens, the transport of a uniform layer of toner over the surface of the development sleeve to the development position cannot take place evenly, and defects appear in the developed image. At the same time the toner fed from the removable container accumulates with that already present in the development chamber, also under the magnetising action of the stationary permanent magnets inside the development sleeve, so giving rise to an increase in the density and correspondingly a decrease in the fluidity of the toner itself, with the formation of lumps that give rise to defects in the image developed.

In the present state of the art methods are known both for stirring and fragmenting the lumps of toner by means of mechanical devices, and for avoiding the accumulation of toner in the development chamber, by for example the use of a device to control the feed system discontinuously via a sophisticated control system for the degree of filling of the development chamber, such that the toner fluidity is maintained at a correct level; however, such devices have the disadvantages of requiring costly and complex solutions, and of not being completely effective.

Moreover, in present magnetic brush development units, in which the one-component toner is contained and extracted mechanically from a container that can be removed from the development unit, toner compaction can occur inside the removable container, during its transport and storage. When the said removable container is inserted into a development unit, this compaction gives rise to a considerable increase in the magnitude of the torque that needs to be applied to the rotating extraction device to bring the one-component toner out of the removable container, such that in the worst cases the weakest part of the extraction device itself can break.

Still referring to the present state of the art concerning magnetic brush development units in which the one-component toner is contained in a container that can be removed from the development unit, a problem arises indicating that the removable container has become empty and must be replaced by a full one. This entails the two contrasting requirements of guaranteeing that the container is completely empty and that the development chamber still contains sufficient toner to form a uniform layer over the surface of the development drum. In fact, on the one hand incomplete emptying of the removable container of one-component toner, besides incurring additional cost due to wastage of unused toner and making it more difficult to dispose of the removable container in an ecologically acceptable way, can easily give rise to soiling of the electric photocopier, the area around it, and perhaps even the operator who is removing the removable container from the development unit; on the other hand, if the quantity of residual toner in the development chamber is reduced to the point where it is no longer possible to obtain a uniform toner layer over the surface of the development sleeve, this will produce defects in the image developed. Finally, in the present state of the art concerning magnetic brush development units of the type described above, in which the height of the toner layer forming the magnetic brush is limited by the action of a metering blade, it is difficult to devise simple systems to prevent the one-component toner becoming compressed between the outside surface of the development sleeve and the lower face of the metering blade. This gives rise to the formation of a thin film formed of the resin constituting the one-component toner over the surface of the development sleeve. This film alters the mechanical and the triboelectric characteristics of the surface of the development sleeve, making it critical to form a uniform toner layer over the surface of the drum and hence giving rise to defects in the developed image.

SUMMARY OF THE INVENTION

Preferred embodiments of the present invention provide a magnetic brush development unit, in which the magnetizable one-component toner is contained in a removable container, characterized by simple, reliable and inexpensive devices capable of preventing the formation of lumps of toner and of maintaining correct toner fluidity.

A further embodiment of the present invention provides a magnetic brush development unit, in which the one-component toner is transferred from the removable container to the development chamber by means of a flexible rotating non-magnetic strip inside the container, which is capable of automatically regulating the quantity of toner fed as a function of the quantity already present in the development chamber.

Another embodiment of the present invention provides a magnetic brush development unit in which the toner is contained in a removable container from which it is extracted mechanically by means of a rotating flexible non-magnetic strip attached to a drive unit outside the container via a clutch, which normally transmits the rotary motion to the rotating strip until the value of the resistant couple developed by the rotating strip is above a predetermined value, when the said clutch disconnects the rotating strip from the drive unit to avoid breakage of the drive unit itself.

A further embodiment of the present invention provides a magnetic brush development unit in which a sensor device inside the development chamber in a suitable position generates a signal showing that the removable container has been totally emptied of toner while the development chamber still contains a residual quantity of toner sufficient to finish the work initiated without producing defects in the image developed.

A further embodiment of the present invention provides a magnetic brush development unit in which the material of the metering blade that regulates the height of the toner layer on the surface of the development sleeve, whose pressure against the outside surface of the development sleeve and the characteristics of the surface of the sleeve itself are so defined as to prevent the resin of which the one-component toner consists from forming a thin film over the outside surface of the development sleeve, for at least a period of time comparable to the lifetime of the development unit.

These and other aspects of the invention are defined in the appended claims to which reference should now be made.

These and other features embodying the present invention will be made clear by the following description of a preferred form of construction of a magnetic brush development unit for electric photocopiers, which is presented by way of example but is not limiting in any way, and with reference to the attached drawings.

DESCRIPTION OF THE PREFERRED FORM

Figure 1:
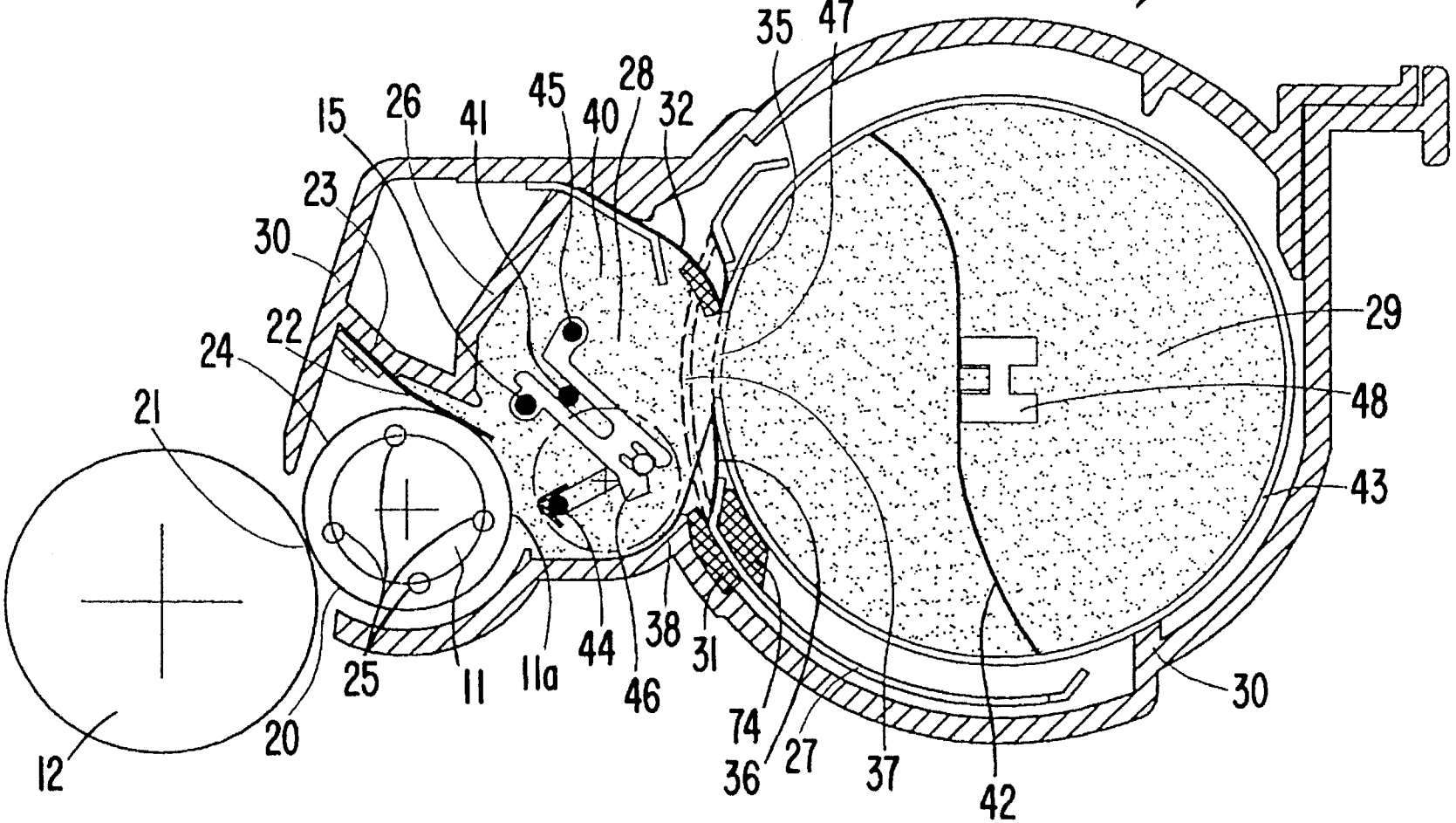
FIG. 1 is a schematic sectional view of a development unit, showing its general features.

With reference to FIG. 1, the magnetic brush development unit 10 comprises a development roller 11 arranged close to a photoconducting drum 12 in a direction parallel to the axis of the photoconducting drum. The development roller 11 consists of a sleeve 20 of non-magnetic material that rotates on a structure 30 of the development unit, and inside which are contained a number of stationary permanent magnets 25. The magnetic poles of the ermanent magnets 25 arranged inside the sleeve 20 are located in such a way that adjacent poles are of opposite magnetic polarity. When the sleeve 20 is rotated in the anti-clockwise direction, a toner 28 contained in a development chamber 40, described in greater detail below, forms a magnetic brush over the surface 24 of the sleeve 20.

At the development position 21, the magnetic brush is brought in contact with the photoconducting drum 12, on which a latent electrostatic image has previously been formed. Toner is deposited on the electrostatic image on the drum such that it is developed into a visible image.

Figure 2:
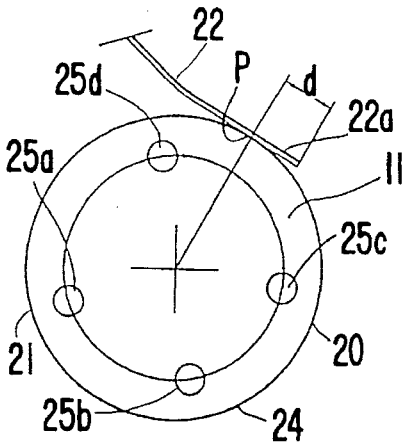
FIG. 2 is a schematic representation of the working position of the flexible blade which regulates the height of the toner layer forming the magnetic brush.

The thickness of the one-component toner layer on the surface 24, and consequently the height of the magnetic brush at the development position 21, is determined mainly by the action of a metering blade 22 fixed at one end to a rigid support 23 of the structure 30. The blade 22 rests elastically against the surface 24 of the sleeve 20 along a tangent indicated as "P" in FIG. 2, and consists of a non-magnetic steel strip of thickness from 0.01 to 0.5 mm (preferably from 0.01 to 0.1 mm) coated with a layer of silicone rubber of thickness from 0.1 to 1.0 mm. The outside surface 24 of the sleeve 20 is treated by a sand-blasting process, first with alumina particles of an irregular shape with sharp points, and then with glass beads, to impart a surface roughness between 1 and 4 Rz as described, for example, in European Patent Application EP 407125. The pressure exerted due to the elastic deformation of the metering blade 22 on the outside surface 24 of the sleeve 20 is adjusted by trial and error as a function of the characteristics of the one-component toner 28, the intensity of the magnetic field, the geometric position of the poles of the permanent magnets 25, and the rotation velocity of the development roller 11, such that the height of the toner layer forming the magnetic brush at the development position 21 will be such as to obtain optimum development of the latent image on the photoconducting drum 12.

A further element that contributes to determining the height of the magnetic brush toner layer at the development position 21 is the length "d" of a part **22*a* of the metering blade 22 that projects beyond the point "P" of contact between the blade 22 and the development roller 11 on the side opposite to the support 23. By appropriate adjustment of all the parameters discussed above, it is possible by trial and error to set up a condition in which optimum quality is obtained for the development of the latent image on the photoconductor 12, at the same time ensuring that the formation of a resin layer on the outside surface 24 of the sleeve 20 is delayed for a time equal to the planned lifetime of the entire electro-photographic apparatus of which the development unit 10** forms a part.

In fact, it is known that under operating conditions in the present state of the art, a phenomenon can occur, as already mentioned, known as "filming" by those familiar with the field, that consists in the progressive coating of the outside surface 24 of the sleeve 20 with a film formed of the resin constituting the toner. This results from the abrasive action of the outside surface 24 of the sleeve 20 on the toner compressed against the outside surface 24 by the pressure exercised by the blade 22.

On the basis of experiments carried out by the inventor, optimum development quality was obtained for 300,000 A4 copies by an electro-photographic apparatus using the development unit 10 under the conditions described below:

(A) One-component toner based on acrylostyrene resin with a mean particle size of 7–8 μm.

(B) A magnetic pole **25*a* for the development of the magnetic roller 11 at the development position 21, of intensity ranging from 800 to 1200 (preferably equal to 1000) G, a second pole 25*b* of opposite polarity to the development pole 25*a*, of intensity ranging from 600 to 900 (preferably equal to 750) G, displaced by 60°–100° (preferably 80° ) in the rotation direction of the sleeve 20, a third pole 25*c* of the same polarity as the development pole 25*a*, of intensity ranging from 600 to 900 (preferably equal to 710) G and displaced a further 60°–100° (preferably 85°) in the rotation direction of the sleeve 20, and a fourth pole 25*d* of polarity opposite to that of the development pole 25*a*, of intensity ranging from 500 to 900 (preferably equal to 700) G and displaced by a further 80°–120° (preferably 102°) in the rotation direction of the sleeve 20**.

(C) Projection "d" of the blade 22 from the point "P" of tangential contact with the development roller 11 in the direction from which the toner comes, ranging from 1 to 10 mm (preferably equal to 4 mm).

(D) Pressure exerted by the non-magnetic blade 22 on the outside surface 24 of the sleeve 20 ranging from 0.1 to 2.0 (preferably equal to 0.6) N/cm.

Still referring to FIG. 1, the development unit 10 comprises a development chamber 40 defined by a portion 11*a* of the development roller 11, a wall section 26 of the structure 30, and by the elements 27, 32 and 38 which will be more fully described below. Inside the development chamber 40 there is a sensor device to sense the presence of toner, consisting of a rigid metallic non-magnetic wire 41 fixed at either end to opposite walls of the chamber 40. The wire 41 is arranged parallel to the sleeve 20 along its entire length, and is connected to an electroni measuring circuit, not shown in the figure, outside the development unit 10; the wire 41 of the toner presence sensor and the sleeve 20 represent the two armatures of a condenser whose capacitance changes depending on whether air or toner 28 is between them, because of their different dielectric constants; this difference in capacity is detected by the electronic measurement circuit, such that a "toner finished" signal is emitted, for example by the illumination of a signal light, to the operator of the electro-photographic apparatus. The position of the wire 41 with respect to the sleeve 20 and the sensitivity of the electronic measuring circuit are adjusted so that the "toner finished" signal appears when approximately 50 g of toner 28 remain in the development chamber 40, this quantity being quite sufficient to allow completion of a photocopying job that may be in progress when the signal appears.

The toner 28 flows into the development chamber 40 through a rectangular slit 37 formed in a movable element 27, which will be more fully described below, and flows out of the development chamber 40 under the action of the magnetic development roller 11; the quantity of toner 28 present in the development chamber 40 is thus variable as a function of the toner consumption, which in turn depends on the quantity of toner required to develop the latent image on the photoconducting drum 12, and on the influx of toner 29 coming from a removable container 43 and pushed by a feed strip 42 through the slit 37 in the movable element 27.

Figure 3:
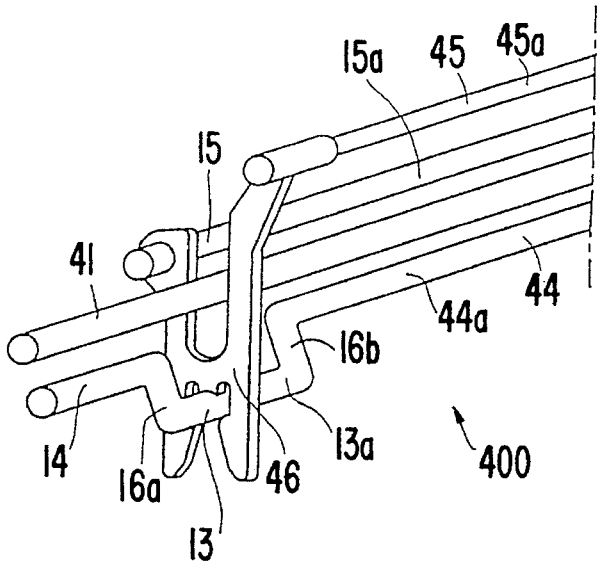
FIG. 3 shows a device to avoid the formation of lumps in the one-component toner inside the development chamber.

To ensure a correct flow of toner 29 from the removable container 43 to the development roller 11, and to avoid the formation of toner lumps in the development chamber 40 as a result of compaction of the toner 28 present in it, inside the development chamber 40 there is a stirring device 400 (of which, for simplicity, FIG. 3 shows only one end, while the opposite end is identical but a mirror image of that shown) comprising a first stirrer element 44 consisting of a bar 44*a* of non-magnetic material arranged parallel to the sleeve 20 and of essentially the same length.

The end part of the stirrer element 44 is bent into the shape of a crank 13 in "swans neck" form, with two sections 16*a* and 16*b* of unequal length such that the section 16*b* is longer than 16*a*. The linear portion 14 of the "swans neck" at one end of the bar 44*a* and the corresponding linear portion at the opposite end act as revolving pivots on opposite walls of the development chamber 40 between which the said stirrer 44 is caused to rotate so that the lower part of the development chamber 40 is "swept" by the bar 44*a*, which thereby impedes the formation of lumps and ensures a regular feed of toner to the development roller 11.

The stirring device 400 also comprises a second stirrer element 45 consisting of a first bar 45*a* of non- magnetic material, and a third stirrer element 15 also formed of a second bar 15*a* of non-magnetic material. The bars 15*a* and 45*a* cooperate with a front fork 46, and with the analogous back fork not shown in FIG. 3, which support and impart movement to both of the bars 45*a* and 15*a*; the fork 46 fits over a linear section 13*a* of the crank 13 and can move transversely with respect to the wire 41 of the toner presence sensor; when the stirrer element 44 is rotated, the bars 45*a* and 15*a* each move along a closed path so that the toner at the top and in the middle of the development chamber 40 is mixed continually, thus ensuring the maintenance of correct toner fluidity and preventing the formation of lumps. In particular, the bar 15*a* contributes to the avoidance of toner retention between the sleeve 20 and the wire 41 of the toner presence sensor resulting from compaction effect caused by the action of the metering blade 22 on the toner transported by the sleeve 20, even when the total quantity of toner 28 present within the development chamber 40 has fallen below a value of approximately 50 g. This toner retention would impede the correct function of the toner presence sensor.

The flexible feed strip 42 (see FIG. 1) in container 43 rotates clockwise, allowing the toner 29 to emerge progressively through a slit 47 formed in the wall of the removable container 43 until the container 43 is completely emptied. The elastic properties of the material forming the flexible feed strip 42, its shape, and the position and width of the slit 47 are determined by trial and error as a function of the characteristics of the toner 29, such that a balance is established within the development chamber 40 so that the toner 29 present in the removable container 43 is only fed in when the compaction of the toner 28 in the development chamber 40 remains between values that guarantee correct toner fluidity and avoid the formation of lumps.

In the form tested by the inventor, the flexible feed strip 42 was made of polyethyleneterephthalate (PET) approximately 0.1–0.5 (preferably 0.2) mm thick, sub-divided into several sections, for example, six sections of equal width, by cuts perpendicular to the rotation axis; the feed slit 47 was approximately 10 mm wide and approximately 320 mm long, and was positioned approximately horizontally; the one-component toner 29 was that already described, with an apparent density of 0.5 to 0.6 g/cm$^3$. The stirrer elements 44, 15 and 45 contribute to the maintenance in equilibrium of toner 28 contained in the development chamber 40, by causing excess toner to flow towards the slit 47 of the removable container 43, such that under normal working conditions the development chamber 40 contains approximately 80 g of toner 28, compared with a capacity of approximately 90 g calculated on the basis of an apparent density of 0.55 g/cm$^3$ of toner 28.

Figure 4:
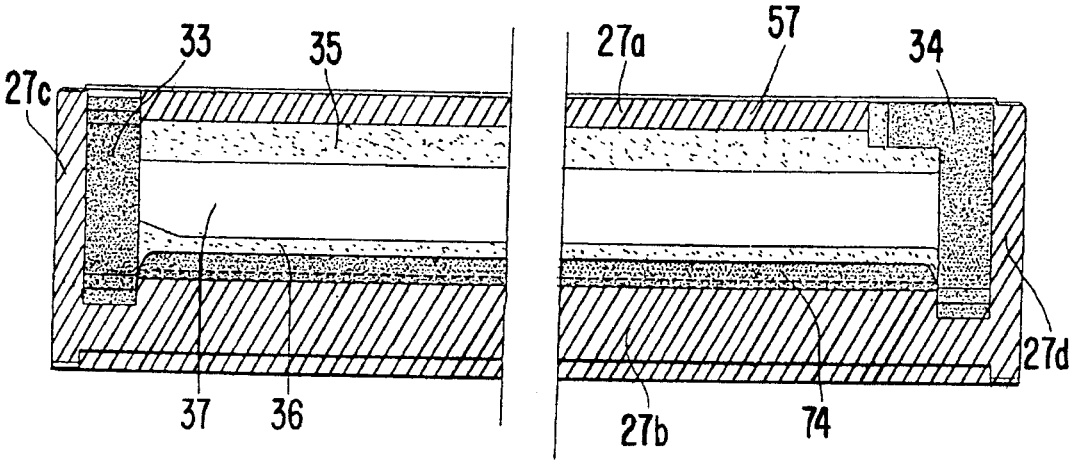
FIG. 4 shows a view of the concave side of the removable toner container element.

The movable element 27 (see FIG. 4) consists of a non-magnetic strip 57 in the shape of a semicircular arc in which is formed in an asymmetric position a longitudinal opening which constitutes the slit 37, whose longitudinal edges 27*a* and 27*b* are folded back towards the inside and support two sealing elements 35 and 36, consisting of PET strips essentially the same length as the slit 37; along the edge 27*b*is stuck a further sealing element 74 which consists of a first layer of polyurethane rubber foam over which there is a second layer of felt, while along the two transverse edges 27*c* and 27*d* of the longitudinal slit 37 are stuck two sealing elements 33 and 34 constructed in the same way.

Figure 5:
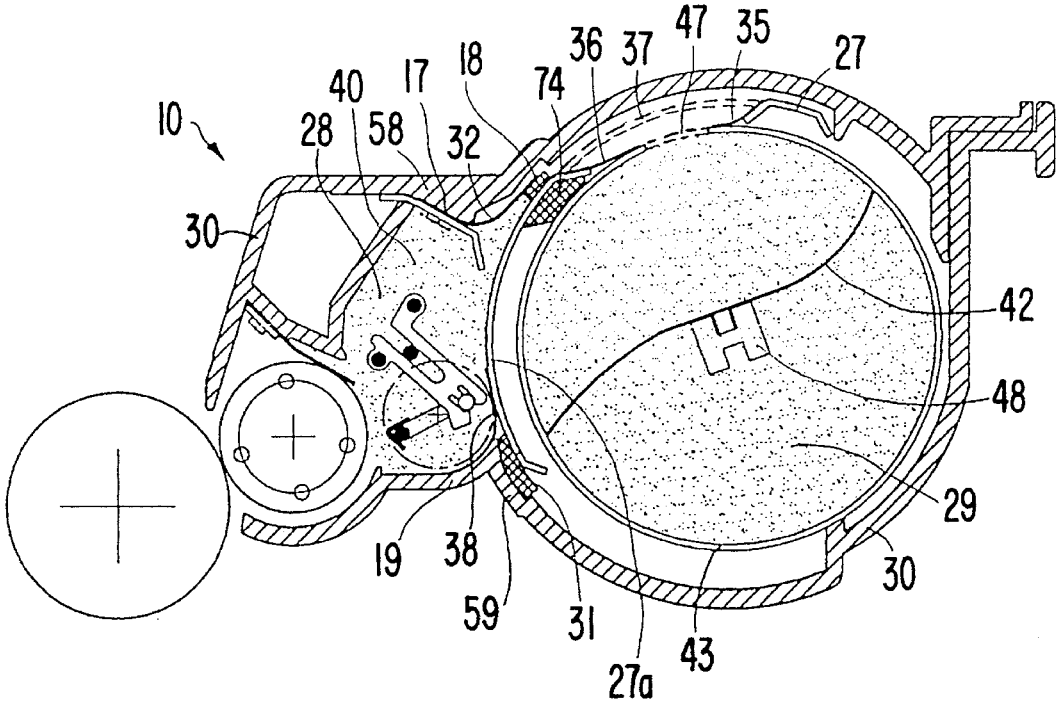
FIG. 5 shows an end sectional view of the development unit with the removable toner container in place, but not in the working position.

When the removable container 43 is not present, or is only inserted inside the development unit 10, the moving element 27 is positioned as shown in FIG. 5 and the toner 28 present in the development chamber 40 cannot flow back into the area within the development unit 10 that houses the removable container 43, since it is held back by a first sealing element 32 consisting of a flexible PET strip 17 attached at one end to a section of the inside wall 58 of the structure 30, while the other end, to which polyurethane rubber foam 18 is stuck, is held pressed against the side of the movable element 27 by the elasticity of the same flexible PET strip 17; by a second sealing element 31 consisting of polyurethane rubber foam fixed to a section of the inside wall 59 of the structure 30, by a third sealing element 38 consisting of a flexible PET strip stuck to a section of the inside wall 19 of the structure 30; and finally by the continuous wall 27*a* of the moving element 27 itself.

Figure 6:
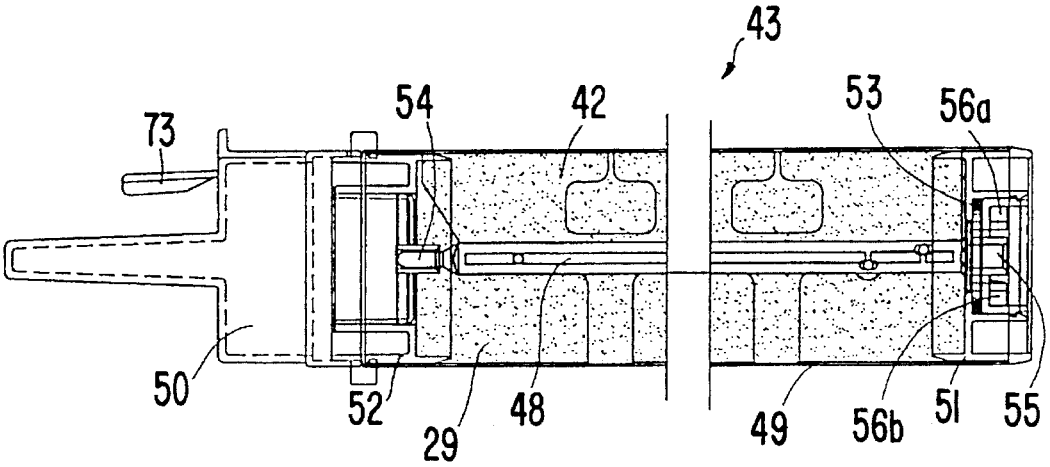
FIG. 6 shows a side sectional view of the removable one-component toner container.

The removable container 43 (see FIG. 6) consists of a cylindrical resin tube 49 approximately 320 mm long, closed at both ends by front and back circular flanges 52 and 51, so enclosing a volume that can contain approximately 400 g of one-component toner 29. The rectangular feed slot 47 (see FIG. 5) is formed longitudinally in the wall of the cylindrical tube 49; to allow the transport and storage of the removable container 43, it is normally sealed, for example by a self-adhesive strip not shown in the figure, which is removed after insertion of the removable container 43 into the development unit.

To the front circular flange 52 (see FIG. 6) is fixed a handle 50, above which there is an eccentrically positioned element 73 that can be acted on by the thumb of the same hand operating the handle, and whose use will be described below.

As shown in FIG. 5, the removable container 43 is inserted into the development unit 10 with the slit 47 in correspondence with the slit 37 of the moving element 27, such that the sealing elements 35 and 36 are pressed against the outside wall of the removable container 43 close to the slit 47 by the elastic reaction caused by the deformation of those sealing elements 35 and 36. To bring the removable container 43 into its working position, as shown in FIG. 1, it must be rotated through approximately 90° anticlockwise; when this is done by simple means, for example a pair of projections attached to the back flange 51, the removable container 43 draws the moving element 27 with it, which thus also rotates through about 90° anticlockwise, moving from the position shown in FIG. 5 to that shown in FIG. 1; after rotation, the slits 47 and 37, which are now aligned, allow the passage of the toner 29 in the removable container 43 into the development chamber 40.

In the working position, the element 73 (see FIG. 6) attached to the handle 50 of the removable container 43 is positioned against a stop, not shown in the figure, attached to the structure 30 in a suitable position to prevent the clockwise rotation of the removable container 43 during the normal operation of the development unit 10; the element 73 can be freed from the stop by being pressed downwards, so allowing the removable container 43 to rotate by about 90° anticlockwise, to enable it to be extracted from the development unit 10 after emptying.

The container 43 also has an internal shaft 48 that supports the flexible feed strip 42 of the toner 29, and that ends at the front in a pivot 54 which fits into a suitable seating formed in the middle of the front circular flange 52 and within which it can rotate; the back end of the internal shaft 48 passes through a hole formed in the middle of the back circular flange 51 and ends in the shape of a cylindrical cup 55 open towards the outside and free to rotate inside the back circular flange 51; a collar 53 of polyurethane rubber foam prevents the toner 29 in the removable container 43 from escaping through the hole formed in the middle Of the back circular flange 51. At the bottom of the cylindrical cup 55 there are two projections 56*a* and 56*b* pointing outwards, and approximately 2.5 mm high, arranged diametrically opposite one another and of triangular section with the apex outwards.

Figure 7:
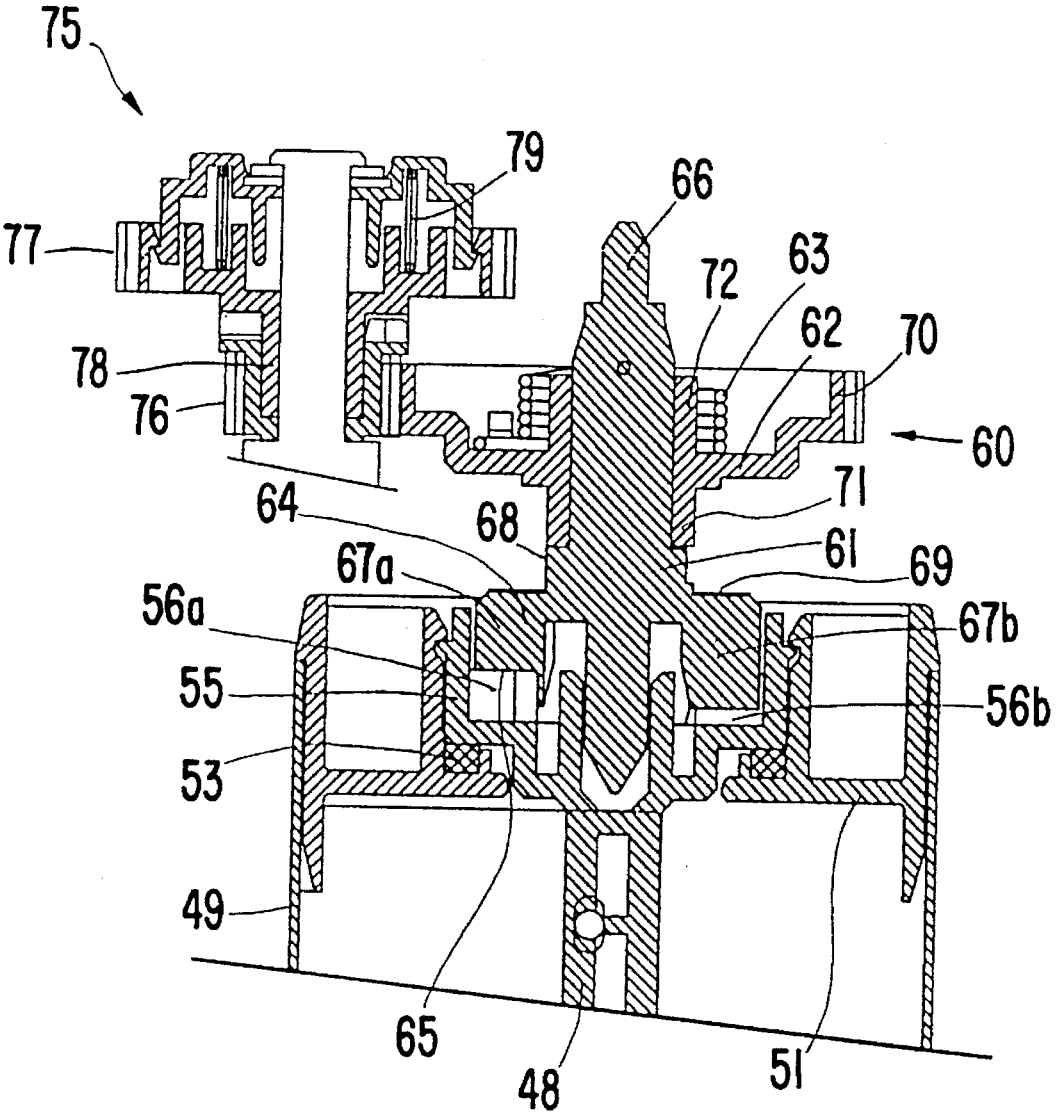
FIG. 7 shows the connection system and clutch that transmits the drive motion to the rotating strip that feeds the one-component toner.

When the removable container 43 is inserted into the development unit 10, the cylindrical cup 55 is positioned opposite an elastic joint 60 (see FIG. 7), whose function is to transmit movement to the internal shaft 48 and hence to the flexible feed strip 42 for the one-component toner 29. The elastic joint 60 consists of an internal member 61, an external member 62 free to rotate coaxially with the internal member 61, and a helical spring 63 whose ends are attached respectively to the internal member 61 and to the external member 62.

The internal member 61 comprises a shaft 66 constituting the pivot on which the external member 62 rotates, and a disc 64 on whose face 65 there are two projections 67*a* and 67*b* of triangular section arranged diametrically opposite one another and with their apexes turned towards the back circular flange 51 of the removable container 43, while on the face 69 opposite to the face 65 there are two projections 68 also diametrically opposite one another.

The external member 62 comprises a toothed wheel 70 and hub 72 on which there are two projections 71 diametrically opposite one another and on a diameter equal to that on which the projections 68 of the internal member 61 are arranged. The pairs of projections 68 and 71, under the action of the helical spring 63, hold the internal member 61 and the outside member 62 motionless with respect to one another in the event of clockwise rotation, while in the case of anticlockwise rotation they allow the internal member 61 to rotate by about 90° with respect to the outside member 62 before coming up against each other, having as the opposing couple only the torsional couple of the helical spring 63. The elastic joint 60 allows the operator to rotate the removable container 43, after its insertion into the development unit 10, by about 90° anticlockwise to position both the moving element 27 and the removable container 43 in the working position, as shown in FIG. 1, by exerting a couple of moderate strength. In fact, even in the case when the removable container 43 is inserted in such a position that the pair of projections 56*a* and 56*b* on the bottom of the cylindrical cup 55 of the internal shaft 48 are directly engaged with the projections 67*a* and 67*b* on the face 65 of the disc 64 of the internal member 61, the removable container 43 can rotate anticlockwise by about 90° without at the same time turning the internal shaft 48 and the flexible feed strip 42 for the one-component toner 29, an operation that could require a high couple due to the compaction effect of the toner 29 caused by the transport and storage conditions of the removable container 43 itself.

The toothed wheel 70 is moved by a dynamometric clutch 75 comprising a driving toothed wheel 77 and a driven toothed wheel 76 rotating on a pivot 78; the facing surfaces of the driven toothed wheel 76 and the driving toothed wheel 77 both have identical frontal grooves, not shown in the figure, forming teeth of trapezoidal shape, and are held in contact with one another by the axial pressure exerted by a compression spring 79. As long as the opposing couple of the toothed wheel 70 remains about 5–15 (preferably about 7–10) kg.cm, the toothed driving and driven wheels 77 and 76 remain in fixed positions with respect to one another thanks to the engagement of their frontal teeth, while when the opposing couple of the toothed wheel 70 exceeds the value of 5–15 (preferably 7–10) kg.cm, the axial pressure exerted by the reciprocal movement of the trapezoidal teeth on the opposing front surfaces of the driven toothed wheel 76 and the driving toothed wheel 77 overcomes the axial pressure of the compression spring 79, and the toothed wheels 76 and 77 move apart from one another such that the toothed drive wheel 77 can rotate without transmitting motion to the toothed driven wheel 76 and consequently to the toothed wheel 70, so safeguarding the integrity of all the elements that cooperate in the transmission of motion to the feed strip 42.

It will be understood that the development unit for electric photocopiers according to the present invention can be modified, by addition and/or substitution of some parts, but without departing from the scope of the present invention.

What it is claimed is:

1. An electrostatic image developing device for electrical photocopiers, comprising:

receiving means for receiving a removable container containing a magnetizable one-component toner, said container having an internal wall;

transfer means for selective transferring of said toner from said removable container into a development chamber of said device, said transfer means comprising a flexible strip made of a non-magnetic material, said strip being fixed to a rotating shaft inside said removable container and extending perpendicularly to said rotating shaft in at least one direction until it comes in contact with said internal wall of said removable container;

a development roller comprising a non-magnetic sleeve rotating in a rotating direction to which a layer of said toner adheres to form a magnetic brush; and stirring means arranged inside said development for stirring said toner, said stirring means comprising a number of bars made of non-magnetic material, and extending parallel to said rotating development roller so as to describe closed paths in different zones of said development chamber, wherein said number of bars comprises:

a first bar having its two ends bent to form a crank rotating on opposite walls of said development chamber, such that said first bar describes a cylindrical path parallel and adjacent to said development roller;

a second and a third bar supported respectively by each of two arms of a pair of fork shaped elements, said two arms extending into an upper part of said development chamber, said pair of fork shaped elements being supported by said crank and oscillating inside said development chamber, and being moved by said crank such that said second and third bars describe two cylindrical paths parallel to said development roller at the top and at the middle of said development chamber, whereby said first, said second and said third bar cooperate with said flexible strip to regulate transfer flow of said toner and to avoid the formation of lumps.

2. An electrostatic image developing device according to claim 1 further comprising sensing means to detect and signal emptying of said toner, contained in said removable container, wherein said sensing means essentially consist of a non-magnetic metallic wire arranged parallel to a surface of said development roller and located inside said development chamber at such a height that said wire is substantially immersed in said toner throughout the time that said transfer means are transferring said toner from said removable container to said development chamber, but above the level of said toner once all of said toner contained in said removable container has been transferred into said development chamber.

3. An electrostatic image developing device according to claim 2, wherein said non-magnetic metallic wire guides movement of said pair of fork shaped elements, such that said two arms of said pair of fork shaped elements can move outside and perpendicularly to said wire.

4. An electrostatic image developing device according to claim 1, wherein said flexible strip consists of a polyethyleneterephthalate (PET) strip of thickness between 0.1 and 0.5 mm.

5. An electrostatic image developing device according to claim 1, wherein said flexible strip is subdivided into several essentially equal sections by slots perpendicular to said rotating shaft.

6. An electrostatic image developing device according to claim 1, further comprising retaining means for containing said toner in said development chamber, and in which said removable container can be moved from a working position to an extraction position, wherein said retaining means comprises:

a moving element, situated between said development chamber and said removable container, essentially consisting of a plate in which is formed an aperture for passage of said toner and sealing gaskets fitted around said aperture; and said moving element can be moved by two pairs of projections attached to said removable container, in such a way that when said removable container is in said working position, said aperture is aligned with an analogous aperture in said removable container, so allowing transfer of said toner from said removable container; while when said removable container is in said extraction position or has been extracted, said aperture in said moving element is in such a position that said developing chamber is no longer in communication with said receiving means for receiving said removable container.

7. An electrostatic image developing device according to claim 1, wherein said rotating non-magnetic sleeve possesses an outer surface treated by a sand-blasting process, said process comprising a first step in which particles of irregular shape and sharp points are used, and a second step in which particles of essentially rounded shape are used.

8. An electrostatic image developing device according to claim 1, wherein said rotating non-magnetic sleeve encloses a number of stationary permanent magnets such as to generate four magnetic poles of alternating polarity, the first of which, corresponding to a development position of the latent electrostatic image, has an intensity between 800 and 1200 G, the second has an intensity between 600–900 G, and is displaced with respect to said first pole by 60°–100° in said rotation direction of said non-magnetic sleeve, the third has an intensity between 600–900 G and is further displaced with respect to said second pole by 60°–100°, and the fourth has an intensity between 500–900 G and is still further displaced with respect to said third pole by 80°–120°.

9. An electrostatic image developing device according to claim 1, further comprising regulating means for regulating the thickness of the magnetic brush, wherein said regulating means essentially consist of a flexible non-magnetic blade fixed at one end to said developing device, and arranged tangentially with respect to said development roller such that, with respect to a contact point "P" with said roller, it projects in a direction opposite said first end by a length between 1 and 10 mm, so as to intercept toner forming said magnetic brush and moving in the rotation direction of said non-magnetic sleeve of said development roller.

10. An electrostatic image developing device according to claim 10, wherein said non-magnetic flexible blade consists of a non-magnetic steel strip of thickness from 0.01 to 0.5 mm coated with silicon rubber of thickness from 0.1 to 1.0 mm.

11. An electrostatic image developing device according to claim 10, wherein said flexible non-magnetic blade is pressed elastically against the surface of said development roller with a predetermined pressure between 0.1 and 2.0 N/cm.

12. An electrostatic image developing device according to claim 1, further comprising transmission means for transmitting movement of a motor to said flexible strip, wherein said transmission means essentially consist of an elastic joint and of a dynamometric clutch, and said elastic joint is attached to said rotating shaft within said removable container to which is fixed said flexible strip, and said dynamometric clutch is located between said elastic joint and said motor.

13. An electrostatic image developing device according to claim 12, wherein said elastic joint applies to said rotating shaft a motive couple of a value less than a value of an opposing couple of said feed strip, whereby said removable container can be rotated by approximately 90° together with said strip and said toner irrespective of the orientation with which said removable container has been inserted in said developing device.

14. An electrostatic image developing device according to claim 13, wherein said dynamometric clutch imparts movement to said elastic joint only when said opposing couple is not in excess of a predetermined value between 5 and 15 kg.cm.

* * * * *